US008631969B2

(12) United States Patent
Faes

(10) Patent No.: US 8,631,969 B2
(45) Date of Patent: Jan. 21, 2014

(54) ARTICLE STORAGE AND RETRIEVAL APPARATUS, AND VENDING MACHINE

(75) Inventor: Steven Michael Faes, Canisteo, NY (US)

(73) Assignee: Teknovation, Ltd. (GB)

( * ) Notice: Subject to any disclaimer, the term of this patent is extended or adjusted under 35 U.S.C. 154(b) by 863 days.

(21) Appl. No.: 11/570,713

(22) PCT Filed: Jun. 15, 2004

(86) PCT No.: PCT/GB2004/002501

§ 371 (c)(1),
(2), (4) Date: Apr. 27, 2007

(87) PCT Pub. No.: WO2004/114233

PCT Pub. Date: Dec. 29, 2004

(65) Prior Publication Data

US 2008/0017660 A1 Jan. 24, 2008

(51) Int. Cl.
*G07F 11/42* (2006.01)

(52) U.S. Cl.
USPC ..... 221/211

(58) Field of Classification Search
USPC ..... 221/211
See application file for complete search history.

(56) References Cited

U.S. PATENT DOCUMENTS

| | | | | | |
|---|---|---|---|---|---|
| 5,765,608 | A * | 6/1998 | Kristen | 141/198 |
| 5,971,205 | A * | 10/1999 | Michaels et al. | 221/135 |
| 6,256,968 | B1 * | 7/2001 | Kristen | 53/512 |
| 6,513,677 | B1 * | 2/2003 | Sorensen et al. | 221/130 |
| 6,547,096 | B1 * | 4/2003 | Chirnomas | 221/123 |
| 6,917,853 | B2 * | 7/2005 | Chirnomas | 700/244 |
| 6,929,149 | B2 * | 8/2005 | Selfridge et al. | 221/211 |
| 2003/0034354 | A1 * | 2/2003 | Chirnomas | 221/2 |
| 2004/0188455 | A1 * | 9/2004 | Shioya | 221/123 |

* cited by examiner

*Primary Examiner* — Timothy Waggoner
(74) *Attorney, Agent, or Firm* — Maynard, Cooper & Gale, P.C.; Jon E. Holland

(57) ABSTRACT

Apparatus for storing and selectively retrieving articles includes a vertical array of storage locations each having a horizontal surface on which articles may rest and along which articles may be slid. A carriage is mounted for movement horizontally and vertically across the face of the array so as to be selectively positionable at any one of the locations, and an arm is mounted on the carriage and selectively extendible and retractable to engage and withdraw a selected article from a first one of the locations on to the carriage, the carriage then being movable to another of the locations at which the arm may be extended to discharge the article from the carriage into the other location.

34 Claims, 9 Drawing Sheets

ARTICLE STORAGE AND RETRIEVAL APPARATUS, AND VENDING MACHINE

CROSS REFERENCE TO RELATED APPLICATION

This application is a U.S. National Phase Application under 35 U.S.C. §371 of International Application No. PCT/GB2004/002501 (published in English) filed Jun. 15, 2004.

FIELD OF THE INVENTION

This invention relates to apparatus for storing and selectively retrieving articles, and to a vending machine incorporating such apparatus.

BACKGROUND TO THE INVENTION

Until recent years most of the mechanisms used in various dispensing machines relied on fixed pitch spiral or fixed pitch conveyor delivery systems. Individual product selections required an individual mechanism for each product, consisting of a powered spiral or a powered segmented conveyor. Such machines suffer from a number of disadvantages, such as low volumetric efficiency of product density due to the fixed pitch nature of the spiral, physical damage to the products caused by forces induced by the spiral, and physically damage to the product caused by dropping the product to a delivery compartment.

An additional disadvantage to most vending machines is that the machines take a long time to load and must be loaded from the rear of the product tray which is a the furthest distance from the door opening. Fixed pitch type delivery systems require that each individual unit of product be placed into its respective slot or position for delivery, further slowing and complicating the loading process.

It is conventional that most vending machines that have a visible front door to view the product require that the product be placed some distance behind the glass partition of the door, thereby limiting the clarity of the products to be selected by the customer. Machines that are low on product appear unappealing to potential customers.

Most vending machines do not have a way to confirm that the product the customer has selected is the same product delivered to the customer. This is a disadvantage to the customer as well as the vending machine operators. It can lead to accounting errors as well as fraud. For example, some machine operator are subsidized by large corporate brands and are obligated to stock the contractually agreed brands. If the operator substitutes non-branded products for the contracted branded products, this can lead to reduced revenue for the corporate brand as well as a breach of contract.

U.S. Pat. Nos. 5,240,139 and 6,547,096 disclose package vending machines comprising means for lifting product with a vacuum pick mechanism in combination with product storage bins and display areas. The present invention seeks to provide a product vending machine of a similar type to this type of machine, but which has an improved mechanism for product dispensing, reliability, innovative product display capabilities, soft delivery, ease of loading and product recognition.

SUMMARY OF THE INVENTION

Accordingly, the invention provides apparatus for storing and selectively retrieving articles, comprising a vertical array of storage locations each having a horizontal surface on which articles may rest and along which articles may be slid, a carriage mounted for movement horizontally and vertically across the face of the array so as to be selectively positionable at any one of the locations, and an arm mounted on the carriage and selectively extendible and retractable to engage and withdraw a selected article from a first one of said locations on to the carriage, the carriage then being movable to another of said locations at which the arm may be extended to discharge the article from the carriage into said other location.

The arm preferably comprises a telescopic suction tube, suitably connected to a fan driven by an electric motor. The tube preferably carries at the free end thereof an elastic cup surrounding the tube and engageable with the article.

The carriage preferably has mounted thereon a drum rotatable by a motor and carrying a flat flexible tape, the free end of which is attached to the free end of the tube whereby the tube may be selectively extended and retracted. A pressure detector may be provided in the suction tube to detect a decrease in pressure resulting from engagement of the tube with the article to be withdrawn, the drum motor being controllable to reverse direction when the decrease is detected, thereby withdrawing the article.

The carriage is conveniently mounted to slide along a horizontal rail which is in turn slidably mounted on a vertical rail, motors being provided for selectively moving the carriage along the horizontal rail and the horizontal rail along the vertical rail.

An optical detector may be provided on the carriage for identifying the article in a storage location. The detector may comprise a digital camera, and this may be linked to image processing and storage means, whereby an image generated by the camera can be compared with stored reference images to identify the article stored at any storage location. Thus, for example, a record may be built up of the articles stored in different locations to facilitate their retrieval.

The array of storage locations preferably includes a delivery location from which an article may be manually retrieved, or alternatively from which it can be transported, for example by a conveyor mechanism.

The invention also provides a vending machine comprising apparatus according to the invention for storing and selectively retrieving articles, located within a closed cabinet providing access only to said delivery location, selection means on the cabinet for sending an article selection signal to control means to indicate the choice of article to be vended by the machine, and payment means for receiving a payment in relation to the article and for sending a payment signal to the control means when the payment has been received, wherein the control means is arranged to control the movement of the carriage and the operation of the arm in response to receipt of the article selection and payment signals to deliver the selected article from the respective storage location to said delivery location.

Preferably, the cabinet is provided with a transparent panel in one vertical face thereof, and the array of storage locations is positioned with the vertical face thereof opposite to that over which the carriage is movable adjacent to the transparent panel, whereby the contents of all the storage locations are visible from outside the cabinet.

The cabinet may include a door for the delivery location, the door preferably being provided with a lock controllable by the control means to release the door when the selected article has been delivered to the delivery location.

The storage and retrieval apparatus of the invention eliminates the need for fixed pitch spirals or segmented conveyors and furthermore the need to drop a product for delivery, improving delivery reliability and minimizing the risk of damage to the product or article. The products or articles can be displayed in a vending machine in the manner of a store window, allowing for improved customer visibility and therefore improved sales.

BRIEF DESCRIPTION OF THE DRAWINGS

In the drawings, which illustrate exemplary embodiments of the invention.

DETAILED DESCRIPTION OF THE ILLUSTRATED EMBODIMENTS

Figure 1:
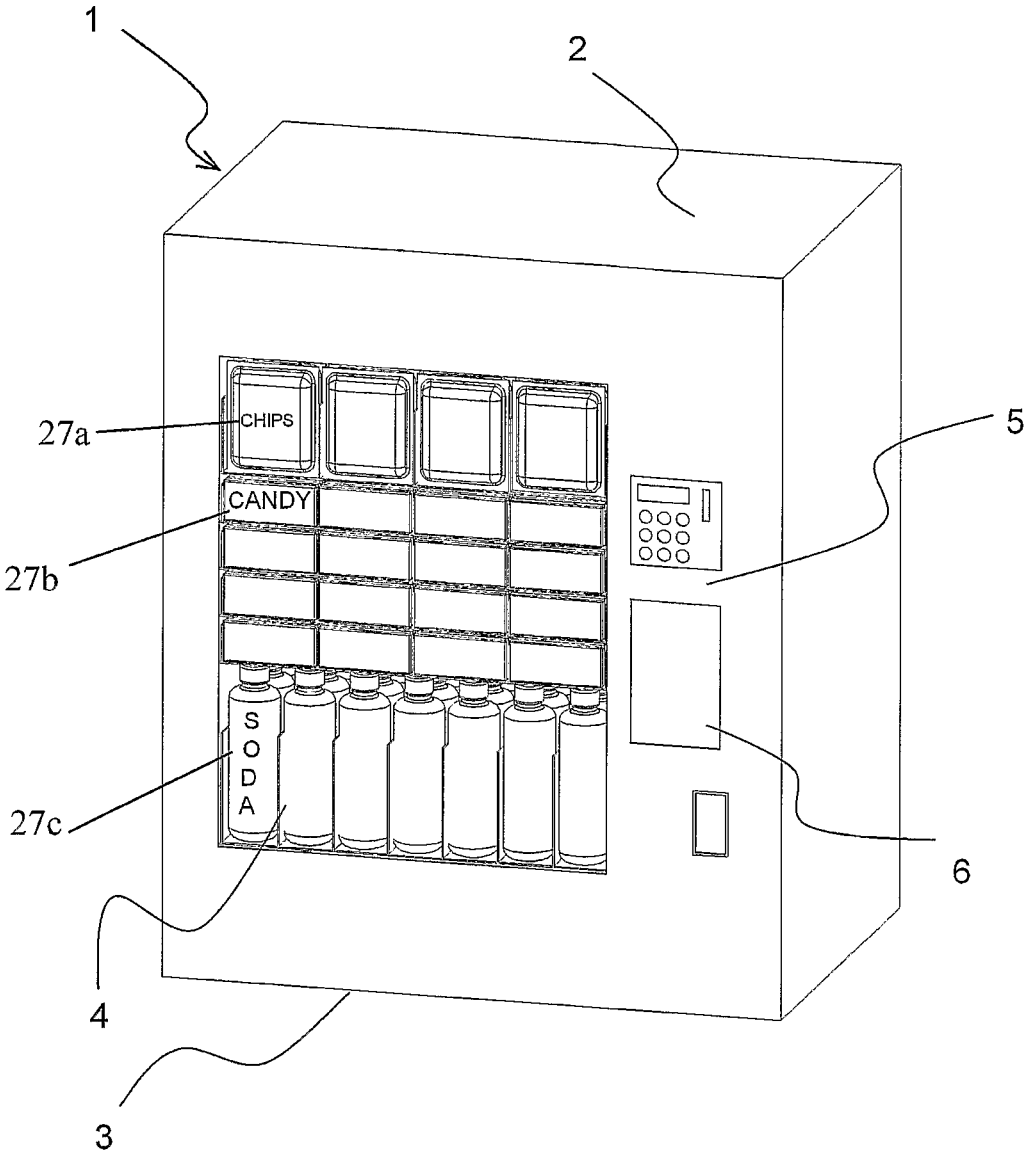
FIG. 1 is a perspective view of a vending machine in accordance with the invention.

FIG. 1 shows a vending machine 1 with a rectangular shape cabinet 2 including a front door 3, a product display panel 4 which is preferably transparent, a product selection panel 5 and a product delivery door 6. The product display panel 4 may be non-transparent for most aspects of the invention as claimed further to exist.

Figure 2:
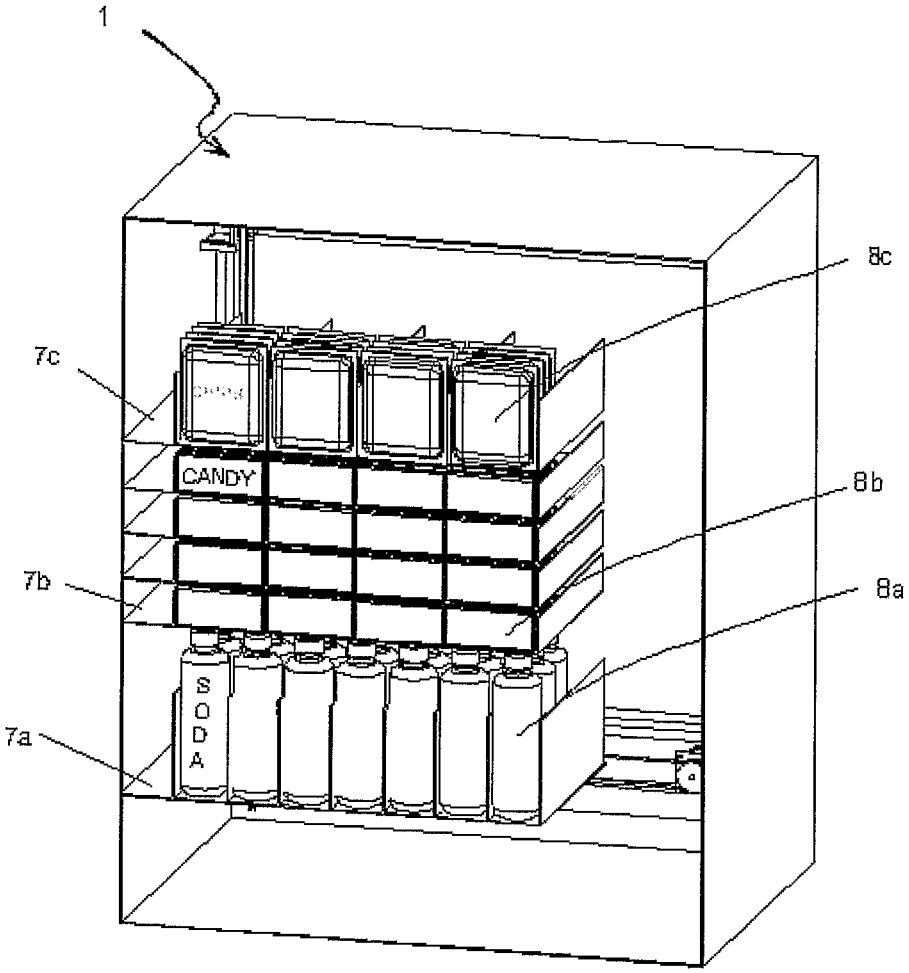
FIG. 2 is a view corresponding to that of FIG. 1, with the front panel of the machine removed.

FIG. 2 illustrates the vending machine 1 with the front door 3 removed for clarity. Directly behind the transparent product display panel 4 resides a series of product trays 7*a*-7*b*. The product trays 7*a*-7*b* are shown with a plurality of products 8*a*-8*c* stored on them. The trays 7*a*-7*b* are arranged in such a way as to allow the products 8*a*-8*c* to be viewed from the customer in a clear and easily recognizable manor. The product labelling 27*a*-*c* can be viewed in a normal reading orientation by the customer. The products 8*a*-8*c* can be loaded into the trays 7*a*-7*b* directly from the front of the vending machine 1 when the front door 3 is opened.

Figure 3:
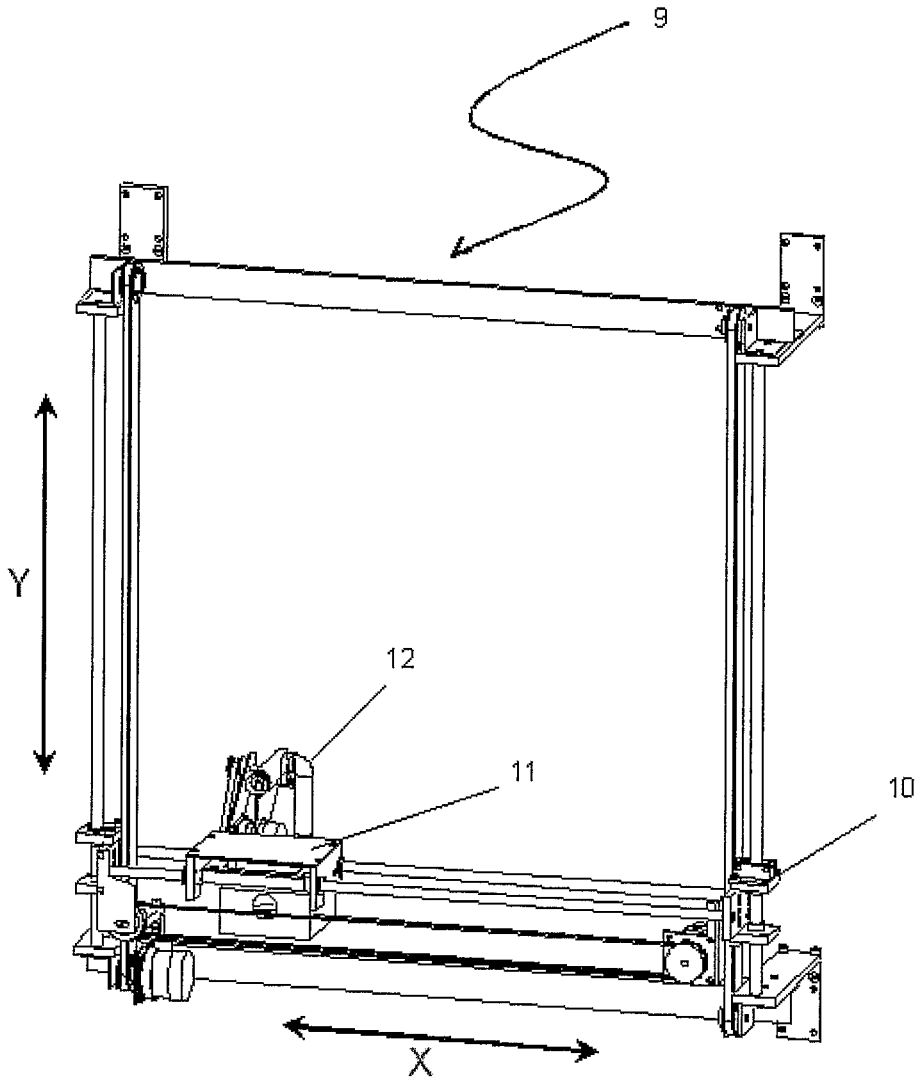
FIG. 3 is a view of a product selector mechanism suitable for use in the machine of FIGS. 1 and 2.

FIG. 3 shows the vending machine 1 with the cabinet completely removed for clarity. An x-y drive mechanism 9 consists of a motorized elevator 10 for creating motion in the y or vertical direction and a motorized carriage or table 11 for creating motion in the x or transverse direction. Attached to the table 11 is a telescoping vacuum pick mechanism 12 which is described in detail below.

Figure 4:
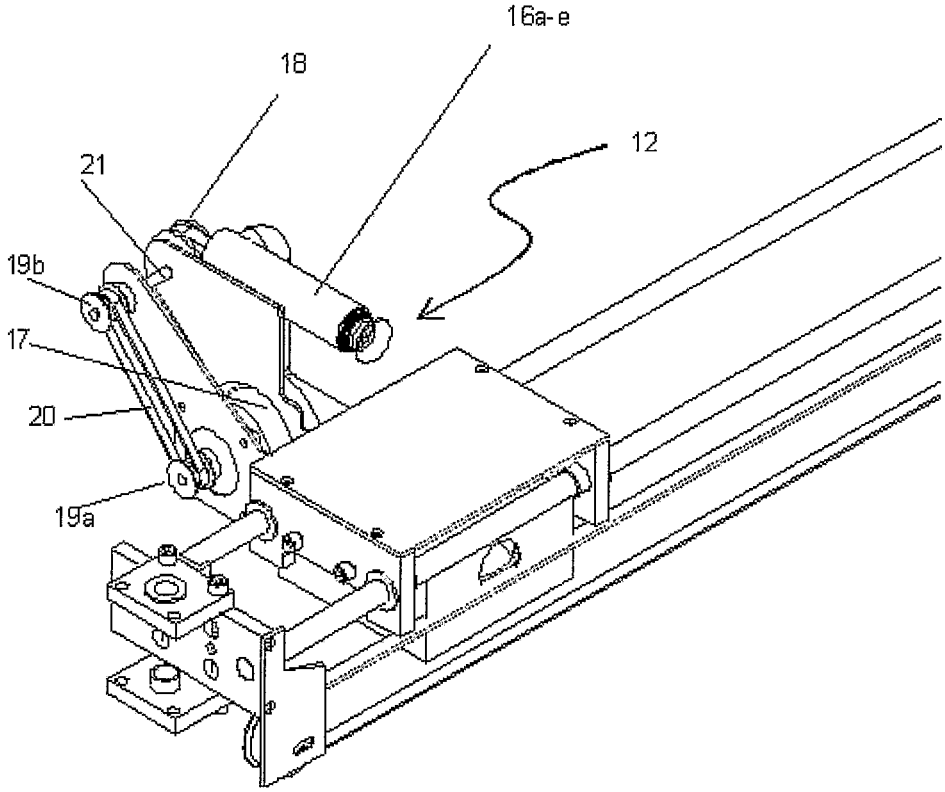
FIG. 4 is an enlarged perspective view of the telescoping pick mechanism which forms part of the product selector mechanism.
Figure 5:
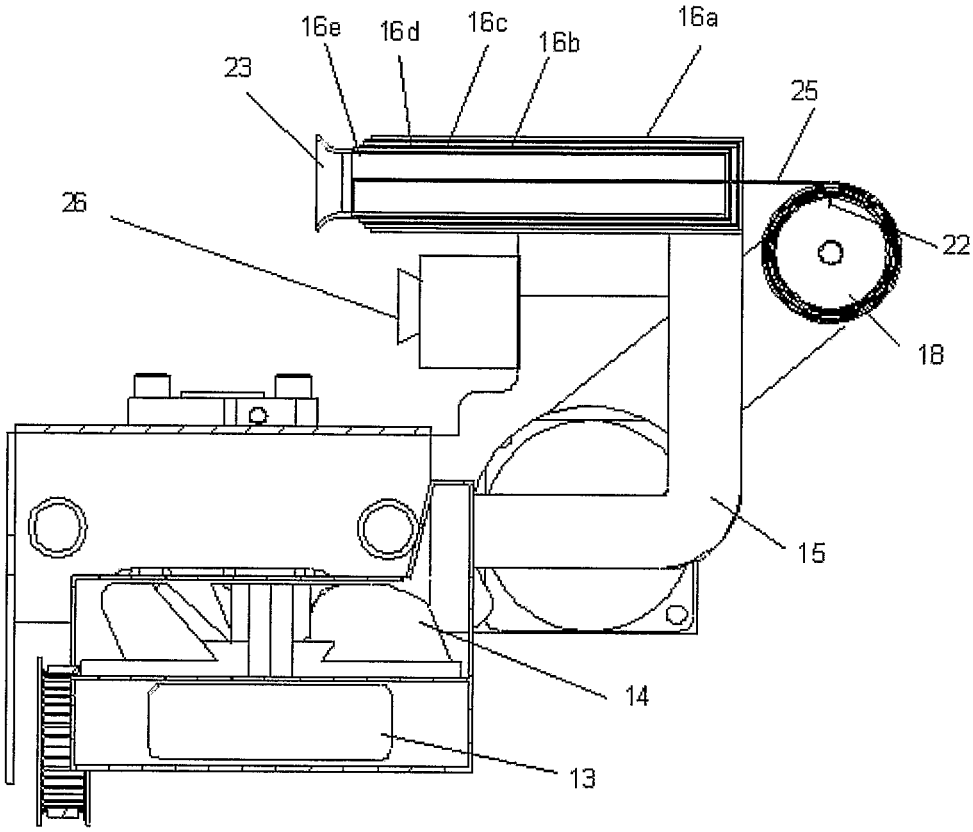
FIG. 5 is a side elevation of the mechanism of FIG. 4.

Referring now to FIGS. 4 and 5, a telescoping pick mechanism 12 consists of a vacuum fan motor 13, a vacuum fan 14 and a suction tube 15 which are rigidly mounted to the table 12. The suction tube 15 is attached to s series of telescoping tubes 16*a*-16*e*. Tube 16*a* is rigidly affixed to the table 11 and connected to the vacuum suction tube 15.

A motor 17 is affixed to the table 11 and connected to a drive drum 18 by means of pulleys 19*a*-19*b*, belt 20, and drive shaft 21. A flat flexible member 25 is connected to the drum 18 by means of a folded tab 22. The member 25 is connected to the end of tube 16*e*. Also connected to the tube 16*e* is an elastic suction cup 23. As motor 17 is energized the drum 18 is caused to rotate imparting a force on the member 25 which in turn imparts a force on tube 16*e* causing it to move in a linear direction and telescope outwards increasing the length of the pick mechanism 12. As tube 16*e* extends further, it contacts and then imparts a force on tube 16*d* causing it to move linearly. The same motion can be generated for the tubes 16*b* and 16*c*. When the motor 17 is reversed the forces are then applied in an opposite direction, causing the tubes 16*b*-16*e* to collapse. The tubes 16*a*-16*e* are contracted in such a way as to provide an air path for providing negative pressure (vacuum) at the elastic cup 23.

Figure 6:
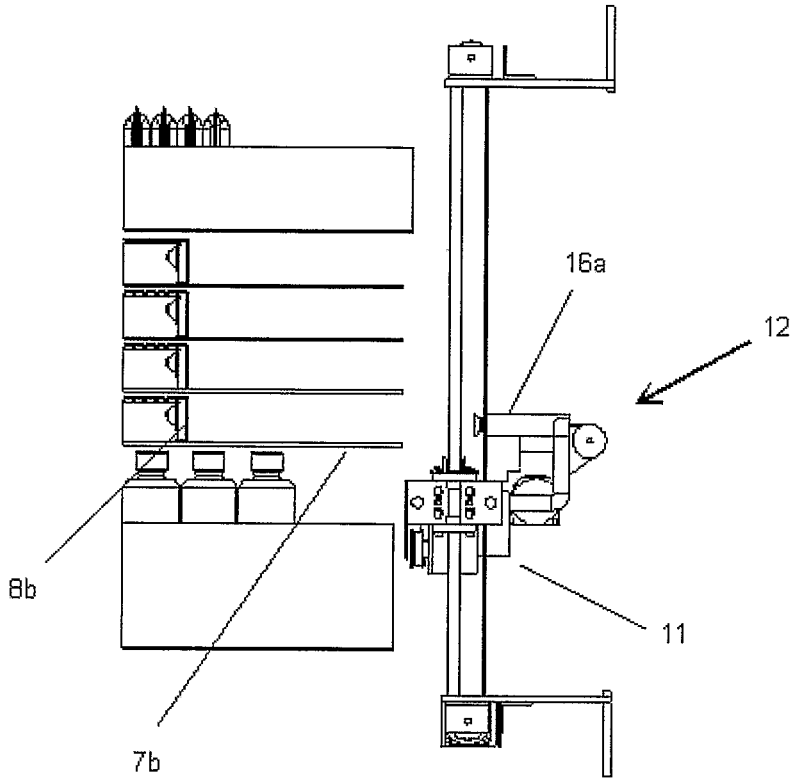
FIGS. 6 to 8 are side views of the machine of FIG. 1, with the casing removed, showing successive stages in the product cycle.
Figure 7:
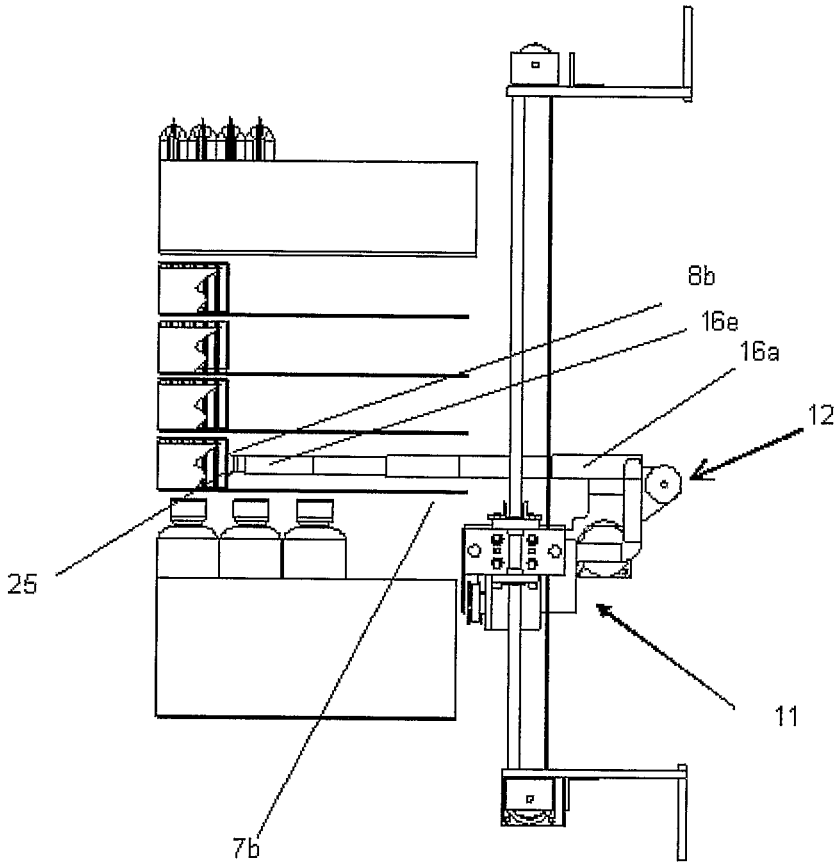

Referring now to FIGS. 6-9, a product cycle is described. A customer would normally select a product by using the panel 5 (shown in FIG. 1). When a product is selected, the drive mechanism 9 positions the table 11 in such a way as to align the pick mechanism 12 with the appropriate product. Referring now to FIG. 6, the pick mechanism is positioned so as to be able to retrieve a product 8*b*. The telescoping pick mechanism is then energized and caused to extend. As shown in FIG. 7, the motor 17 has been energized causing the tubes 16*b*-16*e* to extend. A pressure gauge 24 and a current detect circuit on the fan motor 13 detect a drop in pressure and an increase in current to determine when contact between the elastic cup 23 and the product 8*b* has been made.

Figure 8:
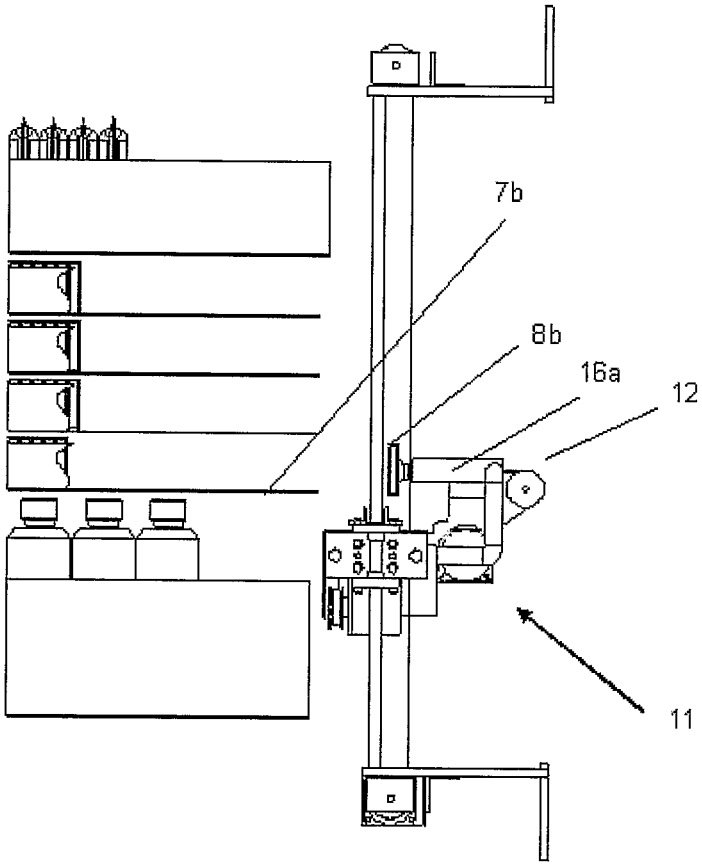
Figure 9:
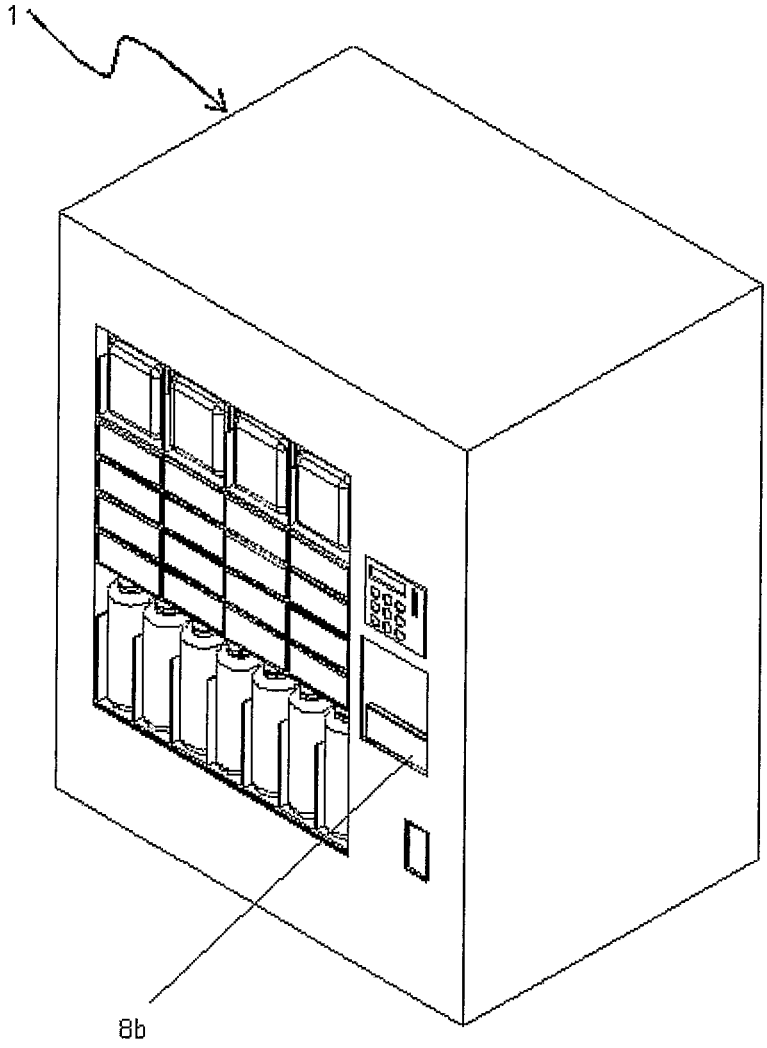
FIG. 9 is a perspective view of the machine at the stage at which the product is released to the customer.

The motor 17 is then reversed, causing the tubes 16*b*-16*e* to collapse as shown in FIG. 8. Referring now to FIG. 9, the x-y mechanism is then energized in such a way as to align the pick mechanism 12 with the product retrieval door 6. The motor 17 is then energized causing the tube 16*b*-16*e* to extend the product to the retrieval door 6. In this manner, the tube serves simply to push the product on to the delivery space behind the retrieval door 6, without the need for suction in the tube, and without causing the product to drop. The door 6 is then opened manually or by motor/solenoid means and the product 8*b* can be retrieved by the customer.

An optical correlator 26 can be mounted to the table 11 in such a way that a stable optical image of any product selected can then be taken. The image is then sent to local or remote data base to correlate product selected versus product delivered.

The invention claimed is:

1. An apparatus for storing and selectively retrieving articles, comprising:

a vertical array of storage locations each having a surface on which articles may rest and articles may be slid;

a carriage mounted for movement horizontally and vertically across a face of the array so as to be selectively positioned at any one of the locations;

an arm mounted on the carriage and selectively extendible and retractable to engage and withdraw a selected article from one of said locations, the arm having a rigid first telescoping tube, a rigid second telescoping tube, and an elastic cup, the first telescoping tube movably connected to the second telescoping tube, the elastic cup connected to said first telescoping tube, the first and second telescoping tubes having an air path;

a drive assembly connected to said first telescoping tube; and a motor operable to provide a vacuum through the air path.

2. The apparatus as recited in claim 1, wherein the motor is connected to a fan, and wherein said cup is connected to said fan through said first telescoping tube and said second telescoping tube.

3. The apparatus as recited in claim 1, wherein said drive assembly further comprises a rotatable drum, a flat and flexible tape connected to said rotatable drum, wherein at least one of the ends of said tape are not connected to said rotatable drum, and wherein an end of said tape that is not connected to said rotatable drum is attached to said first telescoping tube.

4. The apparatus as recited in claim 3, wherein the drive assembly further comprises a motor operable to rotate said rotatable drum thereby imparting a force on said tape for moving said first telescoping tube.

5. The apparatus as recited in claim 1, further comprising an optical detector disposed on said carriage.

6. The apparatus as recited in claim 5, wherein said optical detector comprises a digital camera.

7. The apparatus as recited in claim 6, further comprising image storage means and means for comparing an image generated by said digital camera with an image stored in said image storage means in order to identify the selected article.

8. The apparatus as recited in claim 7, wherein extension of the arm does not cause movement of the digital camera relative to the carriage.

9. The apparatus as recited in claim 6, further comprising a controller, means operatively connected to said controller for accepting payment, means operatively connected to said controller for moving said carriage, means operatively connected to said controller for moving said first telescoping tube, and means connected to said controller for moving said second telescoping tube.

10. The apparatus as recited in claim 1, further comprising a pressure gauge for detecting a drop in pressure when the elastic cup contacts the selected article.

11. The apparatus as recited in claim 1, further comprising circuitry for detecting an increase in current of the motor when the elastic cup contacts the selected article.

12. The apparatus as recited in claim 11, further comprising a pressure gauge for detecting a drop in pressure when the elastic cup contacts the selected article.

13. The apparatus as recited in claim 12, wherein said drive assembly is operable to retract the arm in response to the drop in pressure and the increase in current.

14. The apparatus as recited in claim 11, wherein said drive assembly is operable to retract the arm in response to the increase in current.

15. The apparatus as recited in claim 1, wherein the carriage forms a table having a flat surface directly under the arm.

16. The apparatus as recited in claim 15, wherein the arm positions the selected article over the flat surface after withdrawing the selected article from the one location.

17. The apparatus as recited in claim 1, wherein the carriage is operable to move when the selected article is engaged with the arm such that the selected article is aligned for delivery to a delivery space, wherein the apparatus is operable to extend the arm toward the delivery space thereby pushing the selected article to the delivery space, and wherein the apparatus is operable to disengage the selected article from the arm in the delivery space.

18. The apparatus as recited in claim 17, further comprising a door through which the selected article may be accessed after the selected article has been delivered to the delivery space, the door having a lock controllable to release the door after the selected article has been delivered to the delivery space.

19. The apparatus as recited in claim 17, wherein the apparatus is operable to disengage the selected article from the arm in the delivery space without causing the product to drop.

20. A vending method for storing and selectively retrieving articles, comprising:

storing articles in a vertical array of storage locations, each storage location having a surface on which articles may rest and articles may be slid;

moving a carriage horizontally and vertically across a face of the array;

extending an arm mounted on the carriage, the arm having a rigid first telescoping tube, a rigid second telescoping tube, and an elastic cup, the first telescoping tube movably connected to the second telescoping tube, the elastic cup connected to the first telescoping tube, the first and second telescoping tubes having an air path;

contacting a selected article with the elastic cup during the extending;

applying a vacuum through the air path;

retracting the arm while the elastic cup is engaged with the selected article thereby withdrawing the selected article from one of said locations;

moving the carriage while the elastic cup is engaged with the selected article;

extending the arm while the elastic cup is engaged with the selected article; and releasing the selected article from the arm.

21. The method as recited in claim 20, wherein the extending the arm mounted on the carriage comprises rotating a drum.

22. The method of claim 21, wherein a flat and flexible tape is connected to said drum, wherein at least one of the ends of said tape are not connected to said drum, wherein an end of said tape that is not connected to said drum is attached to said first telescoping tube, and wherein the rotating the drum imparts a force on said tape for moving said first telescoping tube.

23. The method as recited in claim 20, further comprising optically detecting the selected article via an optical detector disposed on the carriage.

24. The method as recited in claim 23, wherein the optically detecting comprises capturing an image of the selected article.

25. The method as recited in claim 24, further comprising:

comparing the captured image to a stored image; and identifying the selected article based on the comparing.

26. The method as recited in claim 25, wherein the optically detecting is performed via a digital camera disposed on the carriage such that the extending the arm mounted on the carriage does not cause movement of the digital camera relative to the carriage.

27. The method as recited in claim 20, further comprising detecting a drop in pressure in the air path when the elastic cup contacts the selected article.

28. The method as recited in claim 27, wherein the retracting is performed in response to the detecting.

29. The method as recited in claim 20, wherein the applying is performed via a motor, and wherein the method further comprises detecting an increase in current of the motor when the elastic cup contacts the selected article.

30. The method as recited in claim 29, wherein the retracting is performed in response to the detecting.

31. The method of claim 30, further comprising detecting a drop in pressure in the air path when the elastic cup contacts the selected article, and wherein the retracting is performed in response to the detecting.

32. The method as recited in claim 20, wherein the carriage forms a table having a flat surface, and wherein the retracting is performed until the selected article is over the flat surface.

33. The method as recited in claim 20, wherein the releasing is performed without causing the selected article to drop.

34. The method of claim 20, wherein the extending is performed such that the selected article is moved behind a door, and wherein the method further comprises:

locking the door; and releasing the door after the releasing the selected article from the arm.

* * * * *